United States Patent [19]

Lunt

[11] Patent Number: 4,485,495

[45] Date of Patent: Dec. 4, 1984

[54] DISPOSABLE CAP FOR NEWBORN BABY

[76] Inventor: Audrey T. Lunt, 6371 Vermont Hill Rd., South Wales, N.Y. 14139

[21] Appl. No.: 435,056

[22] Filed: Jan. 11, 1983

[51] Int. Cl.[3] ..... A42B 1/02; A42B 1/04

[52] U.S. Cl. ..... 2/197; 2/195; 2/200; 2/DIG. 7

[58] Field of Search ..... 2/200, 195, 197, DIG. 6, 2/DIG. 7, 404

[56] References Cited

U.S. PATENT DOCUMENTS

| | | | |
|---|---|---|---|
| 1,505,289 | 3/1923 | Sanders | 2/195 |
| 1,521,149 | 2/1924 | Clarizio | 2/197 |
| 1,712,290 | 6/1928 | Buckman | 2/197 |
| 2,357,392 | 3/1941 | Francis | 264/6 |
| 3,754,284 | 8/1973 | Hartigan et al. | 2/DIG. 7 |
| 3,872,516 | 3/1975 | Bird et al. | 2/200 |
| 4,327,448 | 5/1982 | Lunt | 2/404 |

FOREIGN PATENT DOCUMENTS

| | | | |
|---|---|---|---|
| 721642 | 1/1955 | United Kingdom | 2/200 |

OTHER PUBLICATIONS

Króma, *Manual of Nonwovens,* "Direct Polymer-to--Web Systems" 1.01.3, pp. 217-222. Textile Trade Press, Manchester England, 1971.

*Primary Examiner*—Werner H. Schroeder
*Assistant Examiner*—Mary A. Ellis
*Attorney, Agent, or Firm*—Michael Ebert

[57] ABSTRACT

A standardized, expandable cap for a newborn infant to reduce heat losses from the skull during the hours immediately following birth. The cap is fabricated by die cutting a sheet of non-woven, spunlaced, synthetic fiber material to create blanks having an arched shape, each blank including an arcuate margin and a straight base, the grain of the non-woven material being normal to the base to render it laterally stretchable. A pair of such blanks are superposed and ultrasonically seamed along a line conforming to the arcuate margin to create the dome of the cap. The cap is completed by puckering the lower rear section thereof to create a shirred zone and ultrasonically welding an elastomeric tape thereacross to provide an expandable cap which when worn adjusts itself to the head of the wearer regardless of head size.

5 Claims, 6 Drawing Figures

DISPOSABLE CAP FOR NEWBORN BABY

BACKGROUND OF THE INVENTION

This invention realtes generally to garments made of non-woven textiles, and in particular to a standardized expandable cap made of such textiles for protecting the head of newborn babies, the cap adjusing itself to the head of the wearer regardless of head size.

Body temperature which is nominally at 98.6° F. is determined by the relationship existing between the amount of heat generated internally, which depends on basal metabolism, and the amount escaping from the body. Additional heat is produced as a result of muscular activity. Body heat is dissipated by an increase in radiation, conduction or evaporation from the skin surface.

Thus the skin is the interface between the internallyheated body and the atmosphere and is in heat exchange relationship therewith. If the heat produced by a body surpasses heat losses therefrom, this gives rise to fever or hyperthermia; but if heat losses exceed production, then the body temperature falls below the nominal value, giving rise to shivering and hypothermia.

The nerve centers for regulating body temperature are located in the forebrain region or hypothalamus. These centers sense changes in blood temperature and act to stimulate an appropriate activity to maintain the desired temperature level. Thus, should there be a drop in temperature, there will be a greater expenditure of energy to contribute heat to the blood; and should there be a rise in temperature, sweating and other actions will take place to increase heat losses.

When in a cold climate an adult dresses to keep warm; but should he fail to wear a hat, he may remain cold even if clothed in wool garments; for much more body heat is dissipated from the head than from other areas of the body. And should the adult be more or less bald, the heat losses are then still greater.

A typical newborn babe has a virtually hairless skull, and in the hours immediately following birth, his ability to regulate body temperature is not yet fully operative. It becomes important, therefore, in these critical hours to reduce heat losses from the head of the infant.

Hence in the maternity wards of many hospitals, it is the mandated practice to have all newborn babies wear a cap for the first five or six hours of life to reduce the otherwise considerable loss of heat from the head. And because disposable caps suitable for newborn babies are not commercially available, hospitals presently make their own caps, usually out of a ribbed fabric, for such knitted fabrics have some degree of stretch, and a cap of standard size will fit over the head of the infant regardless of his or her head size.

Apart from the time and expense involved in making such ribbed fabric caps, is the problem of satisfying basic medical requirements. The cap must, of course, be non-toxic and non-allergenic, and it must also be sterile. These requirements are difficult to meet in a hospital-manufactured cap, particularly if the cap must be laundered after use and sterilized. Moreover, the use of a ribbed fabric may afford excessive thermal insulation and result in an overly warm infant. Thus while it is vital that heat loss from the infant's head be reduced, some degree of cooling is also desirable. Accordingly, the ideal newborn cap is one which stabilizes body heat loss, not one which raises body temperature.

It is known to fabricate garments of non-woven synthetic plastic fibers and to use ultrasonic welding techniques for seaming such garments. Thus in my prior U.S. Pat. No. 4,327,448, a non-woven fabric sheet is formed into disposable shorts by cutting the sheet into blanks, a pair of such blanks being ultrasonically welded together to define an open-ended tube which is then further processed to create shorts. But the technique disclosed in my prior patent does not lend itself to making caps for newborn babies which satisfy the special requirements imposed on such caps. Thus many non-woven materials have a texture irritating to the sensitive skin of an infant, or they include binders and other chemical agents to which an infant may be allergic.

SUMMARY OF INVENTION

In view of the foregoing, the main object of this invention is to provide a standardized expandable cap for newborn babies which serves to stabilize heat loss in the hours immediately following birth and which satisfies the special requirements for such caps.

A significant advantage of this cap is that it is inexpensive and therefore disposable; so that once sterilized, it need not be laundered and resterilized.

More particularly, it is an object of this invention to provide a cap formed of a non-woven material which can be readily rendered sterile by simple heat treatment, the material being soft and comfortable, non-irritating and non-allergenic.

Also an object of this invention is to provide a cap of the above type which has sufficient stretchability to fit over and stay on an infant's head regardless of the wearer's head size.

Still another object of the invention is to provide a technique for efficiently mass-producing caps of the above type at exceptionally low cost.

Briefly stated, these objects are attained in a standardized, expandable cap for a newborn infant to reduce heat losses from the skull during the hours immediately following birth. The cap is fabricated by die cutting a sheet of non-woven, spunlaced, synthetic fiber material to create blanks having an arched shape, each blank including an arcuate margin and a straight base, the grain of the non-woven material being normal to the base to render it laterally stretchable. A pair of such blanks are superposed and ultrasonically seamed along a line conforming to the arcuate margin to create the dome of the cap. The cap is completed by puckering the lower rear section thereof to create a shirred zone and ultrasonically welding an elastomeric tape thereacross to provide an expandable cap which when worn adjusts itself to the head of the wearer regardless of head size.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

In general, non-woven fabrics are made of sheets or webs of synthetic plastic fibers or filaments that are bonded together by mechanical, thermal or chemical means, or by solvents. The manufacturer of a non-woven fabric can choose from a wide range of different fibers, bonding agents and finishing techniques, and he has at his disposal various manufacturing processes.

All processes for making a non-woven fabric involve the successive steps of introducing the fibers, distributing the fibers to form a sheet or web thereof, joining the fibers in the sheet together to the degree required, and finally rolling the resultant sheet so it can be transported for subsequent finishing operations or put to actual use.

Among known processes for making non-woven fabrics are the dry process, the film extrusion process and the spunbonded process. But the concern of the present invention is the spunlaced process; for we have found that a non-woven fabric produced by this process satisfies the special requirements for a cap in accordance with the invention.

In the spunlaced process, a fibrous web of synthetic plastic material is first formed and then conveyed longitudinally by a belt under a transverse array of high velocity water jets. These jets bombard the web and act to entangle the fibers and thereby mechanically lock them together. The resultant web is then conducted through a dryer to remove the water and finally to a wind-up mechanism to roll the sheet.

The use of mechanical bonding of fibers in the spunlaced process instead of chemical bonding as in other processes gives rise to a very soft and drapable fabric. One such commercially available, non-woven spunlaced fabric is the "Sontara" polyester blends marketed by DuPont, such as styles 8411, 8412, 8423 and 8900. This soft, non-woven fabric is durable and will not tear or abrade, and is fusable when subjected to ultrasonic energy. This non-woven fabric also meets federal standards for non-flammability, it is non-allergenic and heat sterilizable.

Figure 1:
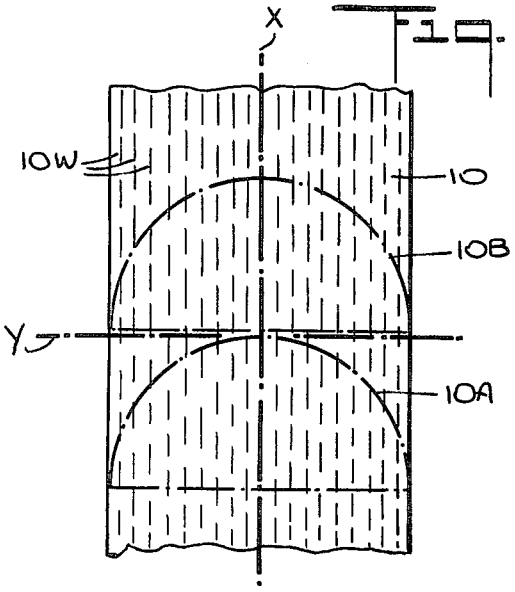
FIG. 1 shows a sheet of non-woven fabric of the type used in making an expandable cap in accordance with the invention.

As shown in FIG. 1, the fabric sheet 10 of spunbonded fabric formed of pure polyester fibers has distinct longitudinally-extending warp lines 10W, thereby creating grain in the axial direction X in which the fabric is conveyed under the array of jets. Because of this grain orientation, the fabric is somewhat stretchable in the transverse axis Y, but it cannot be stretched in the longitudinal axis X.

The first step in the process for producing a cap according to the invention is to advance sheet 10 through a die cutter which yields identical blanks, only a pair of blanks 10A and 10B being shown. In practice, instead of continuous sheeting and a die-cutting operation producing blanks in sequence, a stack of rectangular sheets of the non-woven fabric may be die-cut to produce a stack of blanks.

Figure 2:
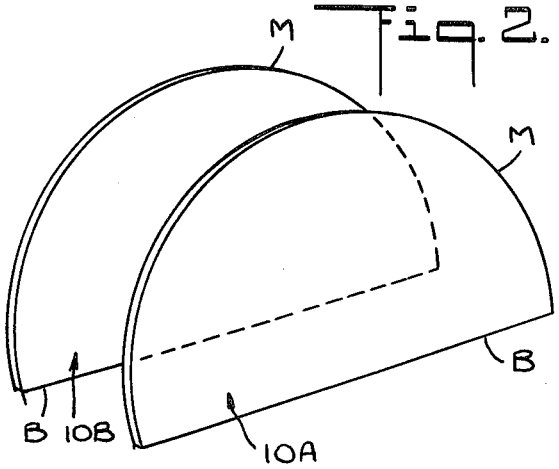
FIG. 2 illustrates a pair of identical blanks die cut from the sheet, from which blanks the cap is fabricated.

Each blank, as shown in FIG. 2, has an arched shape which includes an arcuate margin M and a straight line base B. It is important to note that the blanks are cut from sheet 10 so that grain lines 10W run at right angles to the base B; hence the blanks are laterally somewhat stretchable.

Figure 3:
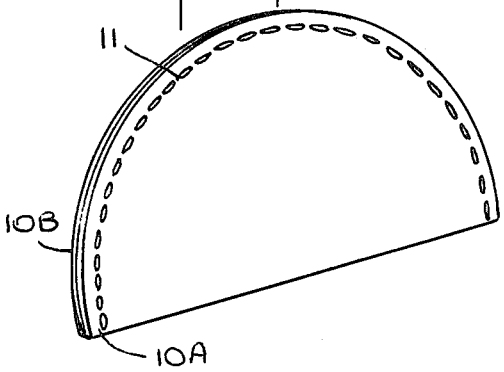
FIG. 3 illustrates the manner in which the blanks are seamed together.
Figure 4:
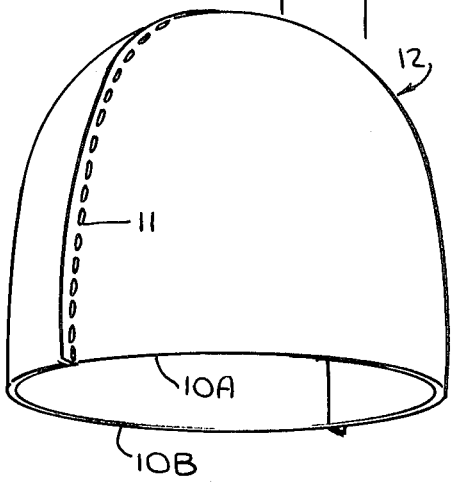
FIG. 4 shows, in perspective, the dome created by the seamed blanks.

The next step, as shown in FIG. 3, is to place blanks 10A and 10B in superposed relation with their margins M and bases B in registration, and to then ultrasonically weld the blanks together along a seaming line 11 which follows the curvature of the margin, thereby creating, as shown in FIG. 4, a dome 12.

The dimensions of the blank are such that the dome is somewhat oversized with respect to a newborn infant's head of average size. Thus the dome would fit loosely over a head of average size, still more loosely on a head below average size, while just about fitting a head of well above average size.

Figure 5:
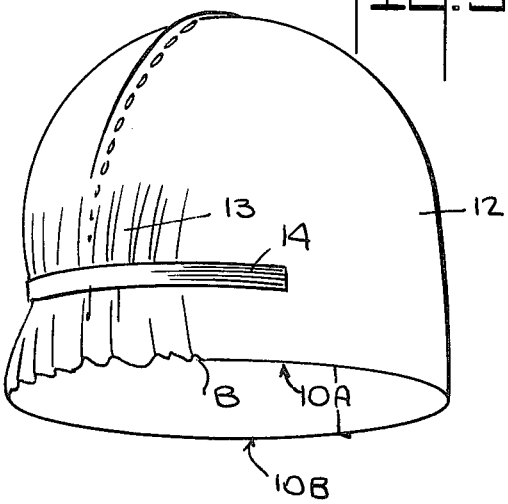
FIG. 5 shows how a tape is secured to the dome to render the resultant cap expandable.

In order to provide a standardized cap that will fit and stay on the full range of different infant head sizes, the final step is to gather or pucker the lower rear portion of dome 12, as shown in FIG. 5, into an array of folds to create a shirred zone 13 that is symmetrical with respect to seam line 11, and to then ultrasonically weld thereacross an elastomeric tape 14 which is parallel to base 13. Thuis as the tape is stretched, the folds proceed to unfold to enlarge the size of the dome.

Figure 6:
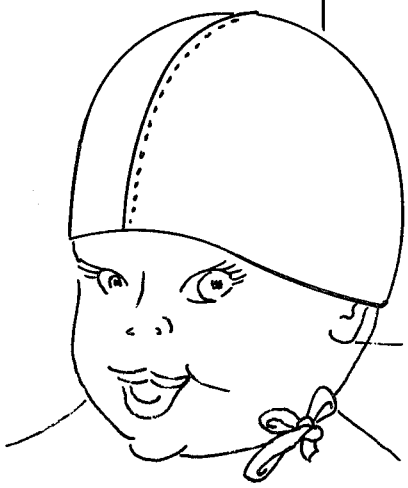
FIG. 6 shows the cap fitted onto the head of an infant.

When the cap is placed on the head of an infant 15, as shown in FIG. 6, regardless of the infant's head size, the cap will conform thereto and stay on the head; for tape 14, which is external to the head, will permit expansion of the cap to the extent dictated by the head size. And because the cap material is somewhat stretchable, the cap will not bind, but will yield to afford a comfortable fit.

After manufacturing the caps and before they are put in suitable boxes or sealed in plastic envelopes, they are heat sterilized (up to 300° F.). And because the material in contact with the head of the infant is soft and comfortable as well as being non-toxic and non-allergenic—for it is composed of pure polyester or other synthetic fiber material free of all binders, chemical agents or solvents—it satisfies all medical requirements for such caps. The fabric sheet of which the cap is composed has adequate thermal insulation value to stabilize heat loss, without creating undue warmth as would occur with a thicker fabric.

While there has been shown and described a preferred embodiment of a disposable cap for newborn baby in accordance with the invention, it will be appreciated that many changes and modifications may be made therein without, however, departing from the essential spirit thereof. Also, the disposable cap may be made in larger sizes for nurses and others who attend infants, for the cap then serves to confine the hair of the wearer and to maintain a sterile environment.

I claim:

1. A standardized cap wearable on the head of a newborn infant to reduce heat losses, said cap fitting on heads in a broad range of infant head sizes, said cap comprising:

A a pair of identical fabric blanks in superposed relation having an arched shape including an arcuate margin and a base, said blanks being formed of an ultrasonically fusable, non-woven, synthetic sheet material and being ultrasonically seamed along a line conforming to the margin to create a dome having a seamed ridge which protrudes from the exterior thereof and whose size is such that the dome will fit over the largest size in said range, said material having a grain orientation which renders it non-stretchable in the longitudinal direction which is normal to said base and somewhat stretchable in the transverse direction, whereby the cap is yielded to afford a comfortable fit; and B a tape ultrasonically welded across the lower rear exterior section of the dome which is formed into an array of folds to define a shirred zone, the taped zone, reducing the size of the dome to below the smallest size in the range, the tape being of stretchable material whereby the zone is expandable to accommodate the cap of any head size in the range.

2. A cap as set forth in claim 1, wherein said material is composed of pure polyester fibers free of bonding or other chemical agents.

3. A cap as set forth in claim 1, wherein said tape is formed of elastomeric material.

4. The method of forming a cap to be worned by newborn infants to reduce head heat losses, said method comprising the steps of:

A die-cutting a sheet of ultrasonically fusable, non-woven, spunbonded fabric material having a longitudinally-extending grain which is non-stretchable in the longitudinal direction and somewhat stretchable in the lateral direction to produce identical laterally stretchable blanks having an arched shape including an arcuate margin and a straight base, the grain in the blanks being normal to the base thereof;

B placing a pair of such blanks in superposed relation and ultrasonically seaming the blanks along a line conforming to the margin to create a dome having a seamed ridge which protrudes from the exterior surface thereof;

C forming an array of folds in the rear lower exterior section of the dome to produce a shirred zone; and D ultrasonically welding an elastomeric tape across the zone to form an expandable cap.

5. The method as set forth in claim 4, wherein said sheet is formed of polyester fibers and is free of all chemical agents.

* * * * *